US005191715A

United States Patent [19]

Jopt

[11] Patent Number: 5,191,715

[45] Date of Patent: Mar. 9, 1993

[54] DRAFTING HEAD FOR A DRAFTING MACHINE

[75] Inventor: Uwe Jopt, Wilhelmshaven, Fed. Rep. of Germany

[73] Assignee: Franz Kuhlmann Prazisions-Mechanic und Mashinenbau GmbH & Co. K.G., Wilhelmshaven, Fed. Rep. of Germany

[21] Appl. No.: 740,806

[22] Filed: Aug. 6, 1991

[30] Foreign Application Priority Data

Aug. 16, 1990 [DE] Fed. Rep. of Germany ..... 4025886

[51] Int. Cl.[5] ..... B43L 13/08

[52] U.S. Cl. ..... 33/438; 33/439; 33/441

[58] Field of Search ..... 33/438, 439, 440, 441, 33/442, 443, 444, 445, 446, 447, 448, 449, 450, 1 N

[56] References Cited

U.S. PATENT DOCUMENTS

| | | | |
|---|---|---|---|
| 2,900,728 | 8/1959 | Wallace | 33/439 |
| 3,339,285 | 9/1967 | Baker et al. | 33/439 |
| 3,508,336 | 4/1970 | Lamb | 33/438 |
| 3,667,126 | 6/1972 | Wackerfuss | 33/438 |
| 3,871,101 | 3/1975 | Becattini et al. | 33/438 |
| 4,486,956 | 12/1984 | Bruneau | 33/438 |

FOREIGN PATENT DOCUMENTS

| | | | |
|---|---|---|---|
| 424161 | 1/1926 | Fed. Rep. of Germany | 33/438 |
| 484526 | 10/1929 | Fed. Rep. of Germany | 33/441 |
| F10914 | 12/1955 | Fed. Rep. of Germany | 33/438 |
| C 6044 | 10/1956 | Fed. Rep. of Germany | 33/438 |
| 3136872 | 3/1983 | Fed. Rep. of Germany | 33/438 |
| 3202243C2 | 8/1983 | Fed. Rep. of Germany . | |
| 349978 | 4/1937 | Italy | 33/438 |
| 619399 | 4/1961 | Italy | 33/438 |
| 82515 | 8/1956 | Netherlands | 33/438 |
| 248009 | 1/1948 | Switzerland | 33/438 |
| 0670470 | 6/1979 | U.S.S.R. | 33/438 |
| 0732152 | 5/1980 | U.S.S.R. | 33/438 |

*Primary Examiner*—Thomas B. Will

*Attorney, Agent, or Firm*—Merchant & Gould, Smith, Edell, Welter & Schmidt

[57] ABSTRACT

The invention concerns a drafting head for a drafting machine, with a gripping member (4) having several actuating elements (6, 8, 10) arranged on the gripping member (4) and capable of being actuated by a hand of the user that is resting on the gripping member (4) for the purpose of executing various switching statuses, as for example, disengaging, free- (unrestricted) switching, secured braking (locking) of the normal side, respectively for releasing the locking of the normal side of the drafting head (1). Provided here is at least one actuating element (6, 8) for disengaging and/or free-switching of the normal side of the drafting head (1), and one actuating element (10) for locking the normal side of the drafting head (1). Actuating element (10) for locking is arranged on the gripping member (4) such that it rests against the inner surface of the ball of the thumb of the user hand resting on the gripping member (4). Preferably the actuating element (6, 8) for disengaging and/or free-switching can be disposed within the gripping range of the user hand resting on the gripping member (4).

16 Claims, 5 Drawing Sheets

DRAFTING HEAD FOR A DRAFTING MACHINE

TECHNICAL FIELD

The invention concerns a drafting head for a drafting machine, with a gripping member having several actuating elements arranged on the gripping member and capable of being actuated by a hand of the user that is resting on the gripping member for the purpose of executing various switching statuses, as for example, disengaging, free- (unrestricted) switching, secured braking (locking) of the normal side, respectively for releasing the locking of the normal side of the drafting head, with at least one actuating element for disengaging and/or free-switching of the normal side of the drafting head, and one actuating element for locking the normal side of the drafting head being provided.

BACKGROUND OF THE INVENTION

A drafting head of this type is, for example, known from German Reference in which disposed laterally on the gripping member are two actuating elements, namely pushbuttons, and upon actuation are displaceable approximately parallel to the drawing plane for setting the different switching statuses of the drafting head. With the first actuating element, the normal side of the drafting head can be disengaged and can free-switch over into an over stroke position. With the other actuating element, the normal side of the drafting head can be firmly locked in the actual position. In the case of known type drafting heads, the actuating elements are arranged such that they can be actuated by the tips of the fingers of a user hand resting on the gripping member. Usually, the actuating elements are actuated with the thumb, while the other fingers are used for firmly holding the gripping member and for rotating the drafting head. After disengaging or free-switching the normal side of the drafting head, often occurring during use is that the drafting head is rotated by the user hand that is resting on the gripping member, and firmly holding onto this latter, into a position in which the thumb and also the other fingers no longer find themselves within reach of the second actuating element for locking the normal side of the drafting head. Now, in order that the actuating element for locking be capable of being actuated by the fingers, preferably the thumb, of the hand of the user resting on the gripping member, their position relative to the gripping member must be changed, which is possible only by pivoting or rotating the hand of the user relative to the gripping member, or even by completely letting go of the gripping member and shifting the user's hand. This leads not only to a troublesome manipulation of the drafting head when locking but also frequently to the drafting head being displaced out of the previously-attained working position by the movement of the user's hand. It is indeed also conceivable, in place of the hand resting on the gripping member, to use the other hand for actuation of the actuating element for locking; however, this method of proceeding is likewise really troublesome, since usually the other hand is holding the drafting stylus which, before operating the actuating element for locking, must then first be laid aside.

Therefore, the object of the invention is to further develop a drafting head of the initially-mentioned type such that for locking used will be the user hand that is resting on the gripping member, without its position relative to the gripping member needing to be changed.

This objective, in the case of the drafting head of the initially mentioned type, is satisfied in accordance with the invention by the fact that the actuating element for locking is arranged on the gripping member such that it lies against the inner surface of the ball of the thumb of the user hand resting on the gripping member. Preferably, the actuating element for disengaging and/or free-switching is disposed within the gripping range of the user hand resting on the gripping member.

The advantage of the invention lies particularly in the fact that the drafting head can be switched by the user hand resting on the gripping member into a disengaging of free-switching status, and maintained in this condition, while the actuating element for locking can simultaneously be actuated with the ball of the thumb of the user hand resting on the gripping member and, in this manner, the drafting head can be locked in the actual position set after releasing, without the position of the user hand relative to the gripping member having to be changed, or even having to use the other hand. This is achieved in accordance with the invention by the fact that the actuating element for locking continually—therefore also when rotating the drafting head—rests against the inner surface of the ball of the thumb of the user hand resting on the gripping member. Disengaging and/or free-switching, as well as locking of the normal side of the drafting head can, therefore, be executed only by the hand of the user that is resting on the gripping member, thereby, for locking, the hand of the user does not need to be pivoted relative to the gripping member nor removed therefrom.

Preferably, the actuating element for disengaging and/or free-switching is coupled with the actuating element for locking in such manner that when free-switching the normal side of the drafting head a previously-set locking is released.

According to a particularly preferred form of embodiment of the invention, the actuating element for locking is disposed on the gripping member such that its actuation can be accomplished by means of an actuating force acting perpendicularly to the drawing plane, and in so doing, the actuating element can move toward the drawing plane. This form of embodiment of the invention has the advantage that when actuating the actuating element for locking, no force components that could displace the drawing head are active parallel to the drawing plane. By applying the actuating force perpendicularly to the drawing plane, the drafting head remains in the previously set working position.

The actuating element for locking is preferably constructed as a pivot lever that is pivotable about a pivoting axis running parallel to the drawing plane. In order to realize an ergonimically-favorable maneuverability, this actuating element has at the free end of the pivot lever a thickened section that is partially drawn over the bulge of the gripping member and that rests in large-surface fashion against the inner surface of the user hand resting on the gripping member.

Another preferred form of embodiment of the invention is characterized by the fact that, for disengaging and/or free-switching the normal side of the drafting head, there are disposed opposite to one another a first and a second actuating element, and displaying an opposingly-aligned actuating path, and that a first switching status can be set only with simultaneous actuation of both actuating elements. The advantages of this design lie particularly in the fact that there are provided on the gripping member two actuating elements with a counter-running path of movement and that for setting a first switching status both actuating elements are actuated simultaneously—and oppositely to one another—so that the actuating forces acting opposingly on the drafting head are removed. A displacement of the drafting head is reliably prevented in this manner.

In order to be able to set still other switching statuses with the first and the second actuating element, preferably produced is a second switching status by actuation of the first and/or of the second actuating element.

Particularly preferred, one of the switching statuses can also be adjusted by setting the first and second actuating element commonly into an over stroke position, so that this switching status can also be set without the one-sided reaction of the actuating forces.

Preferably, in the first switching status, the normal side of the drafting head is freely switched, so that the normal side is freely rotatable without engaging into the notch positions. This first switching status is set by simultaneous actuation of the first and of the second switching elements. As a second switching status, by actuating the first or the second actuating element, the normal side of the drafting head can be released from a notched position.

The first and the second actuating elements are preferably constructed as rocker keys that pivot over a small pivoting angle about pivot pins that are attached to the gripping member at a predetermined distance from the base plate.

All actuating elements are preferably biased in their at-rest position by means of springs, so that after actuation they can again assume their initial position.

According to a particularly preferred form of embodiment of the invention, the gripping member is constructed as an oblong bulge whose height perpendicularly relative to the drawing plane is greater than its width parallel to the drawing plane. The bulge-shaped gripping member preferably has, transversely to its longitudinal direction, a cross section having approximately the form of a U- or V-profile, with the base of the U- or V-profile being directed upwardly and capable of being gripped about by the palm of the user's hand. In the longitudinal direction of the oblong bulge, the gripping member has approximately the form of a segment of a circular disk. The upwardly-pointing contour of the bulge, in its longitudinal direction, is approximately circularly curved up to the base plate of the drafting head.

Advantageous further developments of the invention are characterized by the features of the subclaims.

BRIEF DESCRIPTION OF THE FIGURES

Explained in more detail with the aid of the drawing in the following will be an example of embodiment of the invention.

Shown in.

DETAILED DESCRIPTION

Figure 1:
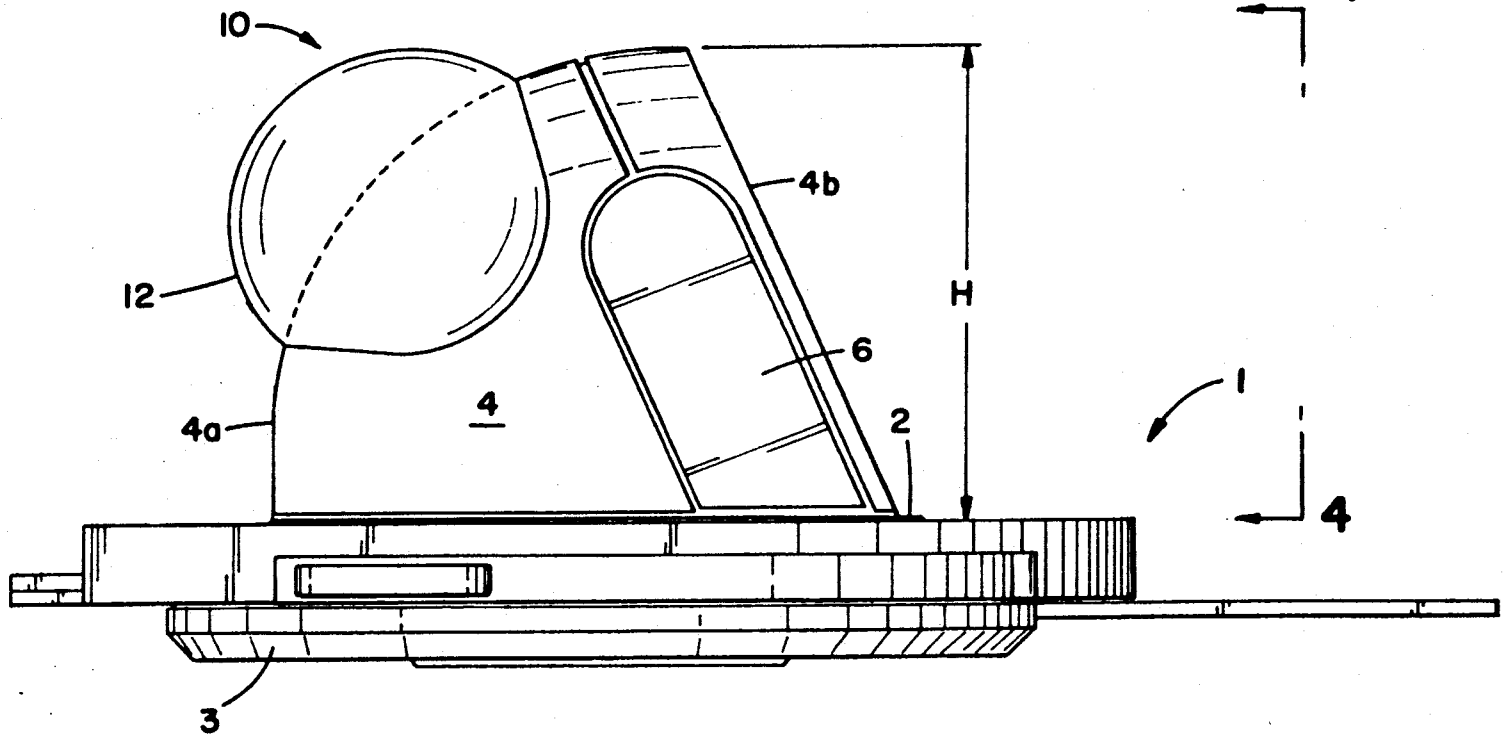
FIG. 1 is a side view of a drafting head.

Fixed to a base plate 2 of a drafting head 1 is a gripping member 4 where the user can grip the drafting head 1 and, when drawing, can move it into the desired position, with the underside 3 of the drafting head 1 facing toward the drawing board of a drafting machine, while the gripping member 4 points toward the user. Arranged on gripping member 4 are several actuating elements 6, 8, 10, by means of which the user can obtain different switching statuses, as for example disengaging, free-switching or locking of the normal side, as well as releasing the locked normal side. The actuating elements 6, 8, 10 for this purpose act upon levers 11, 20, 22 that are in working engagement with the corresponding notches or brakes.

Figure 2:
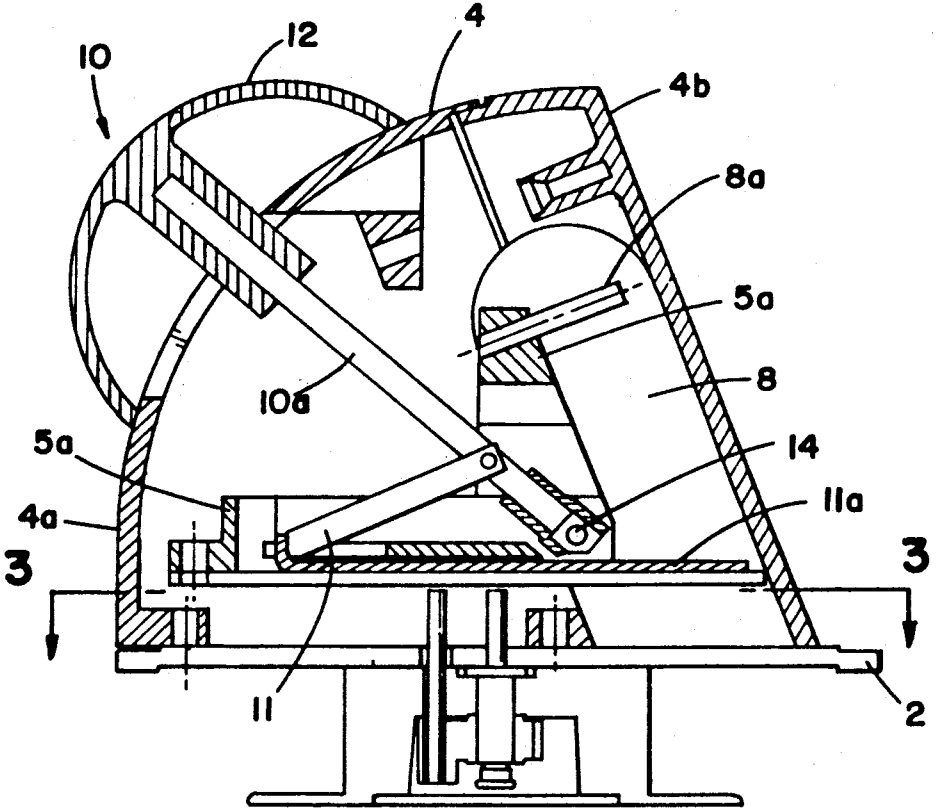
FIG. 2 is a side view of the drafting head in a cut.
Figure 3:
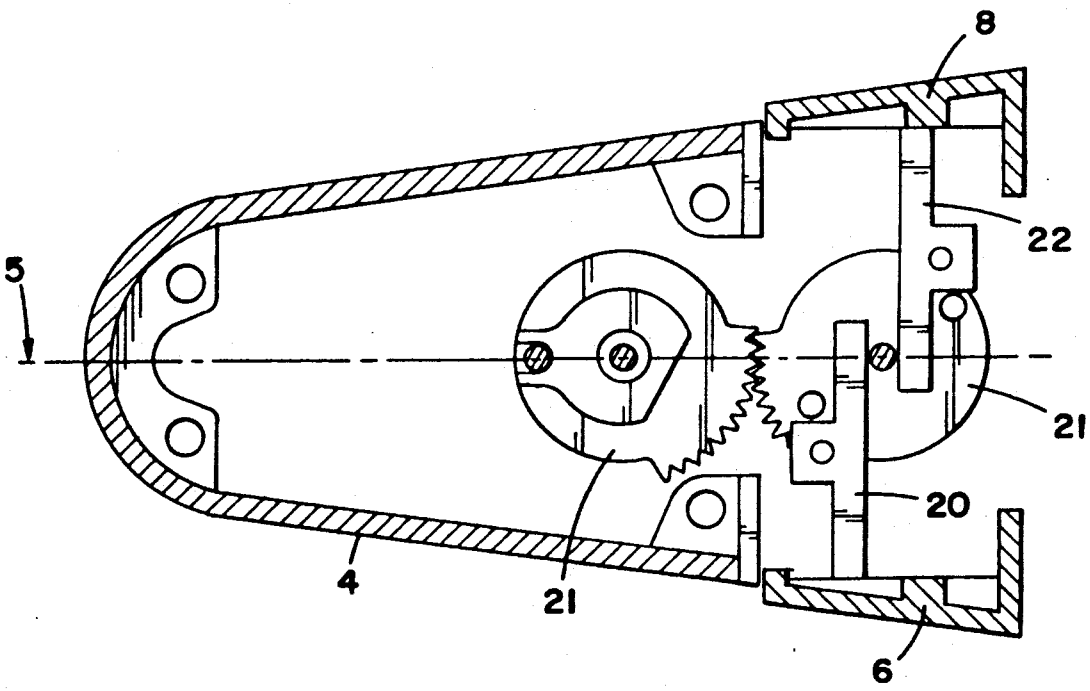
FIG. 3 is a cut along the line II—II through the drafting head of FIG. 1.
Figure 4:
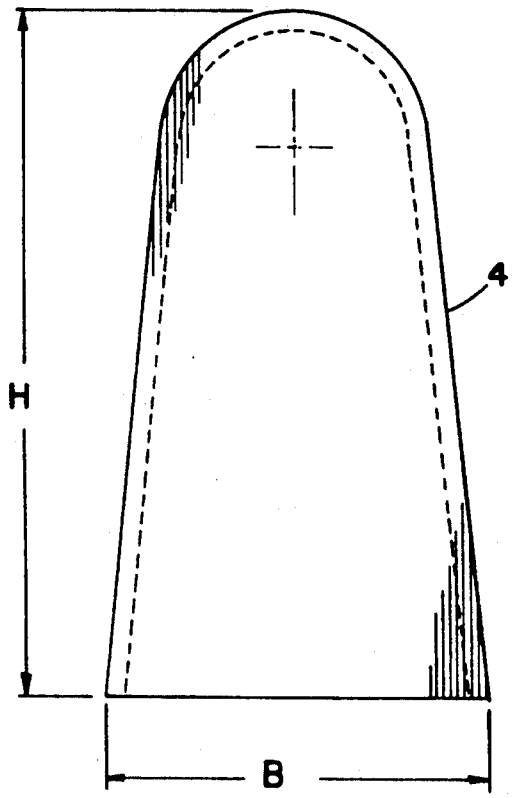
FIG. 4 is a cut along the line III—III through the gripping member of the drafting head based on FIG. 1.
Figure 5:
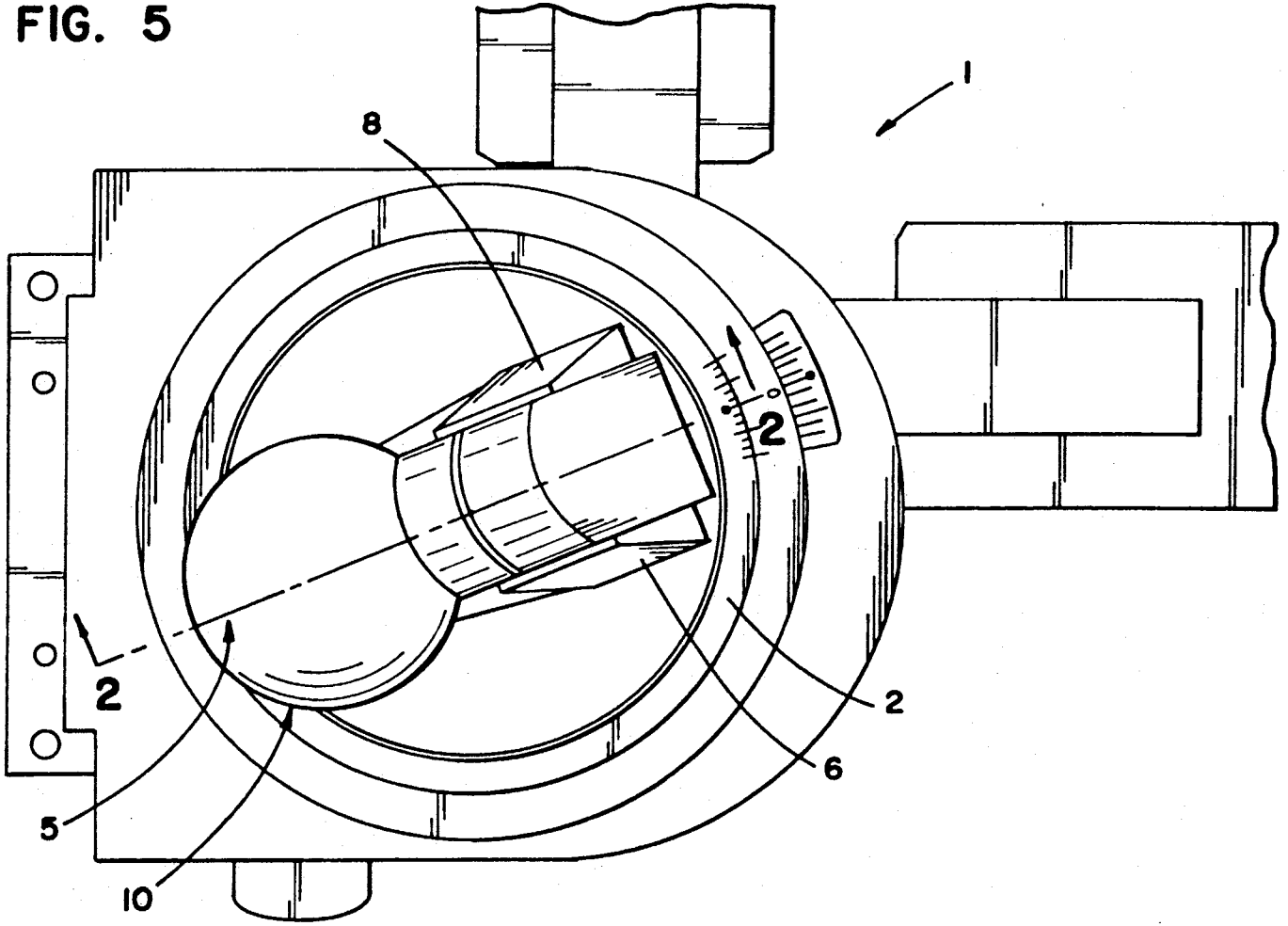
FIG. 5 is a top view onto the drafting head based on FIG. 1.

As can be obtained from FIGS. 1 to 5, the gripping member 4 is constructed as an oblong bulge that extends along a longitudinal axis 5, and whose height H perpendicularly to the plane of the drawing board is greater than its width B parallel to the plane of the drawing board. The bulge-shaped gripping member 4, in accordance with FIG. 4, has a cross section running transversely to the longitudinal axis 5, which corresponds approximately to an overturned or inverted V- or U-profile, with the height of the gripping member 4, in the form of embodiment represented, being a function of the actual position along the longitudinal axis 5. In the side view represented in FIG. 1, the gripping member 4 has a top contour that displays, at least sectionally, the form a section of circle. In the form of embodiment represented, the ridge (crest) of the gripping member 4 runs, from its maximum height H, arcuately curved up to the base plate 2 of the drafting head; from the maximum height H, the gripping member 4 likewise drops off in the longitudinal direction toward the other side, in a plane **4*b***, toward the base plate.

According to FIGS. 1 to 5, the first actuating element 6 and the second actuating element 8 is constructed as a pushbutton or rocker key, both being pivotably journaled, each one about its own pivoting axle **6*a*, 8*a* fixed to a support 5*a*. The two actuating elements 6, 8 are arranged such that they lie opposing one another and display an actuating path directed opposite to each other transversely to the longitudinal axis 5, with a first switching status capable of being set only with simultaneous actuation of both actuating elements 6, 8. A second switching status can be set by actuating one of the two actuating elements, a third switching status by actuation of the other actuating element 6, 8. Actuating elements 6, 8 act, via a transfer drive that includes bars 20 and 22 and gears 21, on the desired detents, notches or brakes of the drafting head 1. Alternatively, the bars 20 and 22, against which the actuating elements 6, 8** operate, can also be structured such that the second switching status can be set with actuation of the first or the second actuating element.

Preferably, the actuating elements 6, 8 react against springs (not represented), and the first switching status can then be set when the two actuating elements 6, 8 reach a pre-established end position, e.g. an over stroke position which, for example, is obtained only with increased pushbutton pressure, with the actuating elements 6, 8, after reaching the end position, again being pressed back into their initial position by the springs.

In the form of embodiment represented, for setting a switching status a third actuating element 10 is arranged on the gripping member 4 such that its actuation path has the essential path components perpendicularly to the drawing plane, so that, when actuating this actuating element, forces act on the drafting head essentially only perpendicularly to the plane of the drawing board. The third actuating element 10 is constructed as a pivoting lever that is pivotable about a pivoting axis 14 fixed in the gripping member, running parallel to the plane of the drawing board. The pivoting lever 10 is guided—about centrally—inside the gripping member 4, and projects outwardly through a longitudinal gap through the ridge of the gripping member 4. Provided at the outwardly-projecting free end the pivoting lever 10 is a thickened section 12 that partially grips about the ridge 4*a* of the bulge-shaped gripping member 4. The third actuating element 10 can be actuated against the effort of a spring, and it is again guided into the at-rest position, after actuation, by the spring. The actuating element 10 acts, for example via a toggle lever 11 and a toothed rack 11*a*, on the actuating element of the drafting head.

In the form of embodiment represented, the first switching status, which is achieved with simultaneous actuation of the first and of the second actuating elements, is used for the purpose of free-switching the normal side of the drafting head. In the second switching status, the normal side of the drafting head is merely disengaged, so that the normal side, after rotating about a prescribed angle, again engages in the next detent position. The third actuating element 10 is for setting the third switching status by locking the normal side. With setting of the first switching status (free-switching of the normal side), simultaneously released will be a previously-set third switching status, therefore, so that when actuating the two first actuating elements, also free-switched will be a previously locked drafting head.

I claim:

1. Drafting head for a drafting machine, comprising a gripping member having several actuating elements arranged on the gripping member and capable of being actuated by a hand of the user that is resting on the gripping member for the purpose of executing various switching statuses, including disengaging, and/or free-switching, secured locking of the normal side and releasing the locking of the normal side of the drafting head, wherein at least one actuating element is provided for disengaging and/or free-switching the normal side of the drafting head, and one actuating element for locking the normal side of the drafting head and wherein the actuating element for locking is disposed on the gripping member such that it rests against the inner surface of the ball of the thumb of the user hand that is to be rested on the gripping member.

2. Drafting head according to claim 1, wherein the actuating element for disengaging and/or free-switching is disposed within the gripping range of the user hand resting on the gripping member.

3. Drafting head according to claim 1 wherein the actuating element for disengaging and/or free-switching is coupled with the actuating element for locking in such manner that, when free-switching the normal side of the drafting head a, previously set locking of the normal side of the drafting head is released.

4. Drafting head according to claim 1 wherein the actuating path of the actuating element for locking has one component perpendicular to the drawing plane.

5. Drafting head according to claims 1, characterized wherein that the actuating element for locking is a pivot lever that is pivotable about a pivoting axis running parallel to the plane of the drawing board.

6. Drafting head according to claim 5, wherein the free end of the pivot lever displays a thickened section that partially grips about the gripping member.

7. Drafting head according to claim 1, wherein for disengaging and/or free-switching of the normal side of the drafting head, opposingly disposed to one another are a first and a second actuating element and displaying an opposingly-directed actuating path, and that a first switching status is capable of being set only with simultaneous actuation of both actuating elements, which the first switching status free-switches the normal side of the drafting head.

8. Drafting head according to claim 7, wherein a second switching status can be set with actuation of the first and/or of the second actuating element, which the second switching status disengages the normal side of the drafting head.

9. Drafting head according to claim 7 wherein the first switching status can be set only when the first and the second actuating element (6, 8) reaches a predetermined end position.

10. Drafting head according to claim 7 wherein the first switching status is capable of being set only when the first and the second actuating element reaches an over stroke position.

11. Drafting head according to claim 8, wherein the second switching status is capable of being set only when the first and the second actuating element reaches an over stroke position.

12. Drafting head according to claim 7 wherein the first and the second actuating elements are constructed as pushbuttons.

13. Drafting head according to claim 12, wherein the first and the second actuating elements are constructed as a rocker key.

14. Drafting head according to claim 7, characterized in that the actuating elements are biased in their at-rest position.

15. Drafting head according to claim 7, wherein the gripping member displays a cross section transversely to its longitudinal direction that corresponds approximately to an inverted V- or U-profile.

16. Drafting head according to claim 14 wherein the cross section of the gripping member corresponds, in the longitudinal direction, at least sectionally, to a segment of area of a circle.

* * * * *

UNITED STATES PATENT AND TRADEMARK OFFICE

CERTIFICATE OF CORRECTION

PATENT NO. : 5,191,715

DATED : March 9, 1993

INVENTOR(S) : Uwe Jopt

It is certified that error appears in the above-indentified patent and that said Letters Patent is hereby corrected as shown below:

Item [73] Assignee, "Prazisions-Mechanic" should read --Prazisions-Mechanik--.

Item [73] Assignee, "Mashinenbau" should read --Maschinenbau--

Signed and Sealed this

Fifteenth Day of February, 1994

*Attest:*

*Attesting Officer*

BRUCE LEHMAN

*Commissioner of Patents and Trademarks*